US009962601B2

(12) United States Patent
Jones

(10) Patent No.: US 9,962,601 B2
(45) **Date of Patent: *May 8, 2018**

(54) AUTOMATED TABLE GAME SYSTEM

(71) Applicant: MARK HAMILTON JONES AND SHERYLE LYNN JONES FAMILY TRUST DATED NOVEMBER 7, 2013, Gardnerville, NV (US)

(72) Inventor: Mark H. Jones, Gardnerville, NV (US)

(73) Assignee: Mark Hamilton Jones and Sheryle Lynn Jones, Gardnerville, NV (US), Family Trust dated Nov. 7, 2013

( * ) Notice: Subject to any disclaimer, the term of this patent is extended or adjusted under 35 U.S.C. 154(b) by 0 days. days.

This patent is subject to a terminal disclaimer.

(21) Appl. No.: 14/149,288

(22) Filed: Jan. 7, 2014

(65) Prior Publication Data

US 2014/0191470 A1 Jul. 10, 2014

Related U.S. Application Data

(60) Provisional application No. 61/749,725, filed on Jan. 7, 2013.

(51) Int. Cl.

| | |
|---|---|
| ***A63F 1/12*** | (2006.01) |
| ***A63F 5/00*** | (2006.01) |
| ***A63F 5/04*** | (2006.01) |
| *A63F 9/24* | (2006.01) |

(52) U.S. Cl.

CPC ..... *A63F 1/12* (2013.01); *A63F 5/0005* (2013.01); *A63F 5/046* (2013.01); *A63F 2009/2489* (2013.01)

(58) Field of Classification Search

CPC ..... A63F 1/12; A63F 1/14
USPC ..... 273/149 R; 463/22
See application file for complete search history.

(56) References Cited

U.S. PATENT DOCUMENTS

| | | | | |
|---|---|---|---|---|
| 2,046,799 | A * | 7/1936 | Tompkins | A63F 1/06 273/149 P |
| 3,176,841 | A * | 4/1965 | Staats | 209/571 |
| 3,273,709 | A * | 9/1966 | Staats | 209/571 |
| 3,377,070 | A * | 4/1968 | Nottoli | A63F 1/14 209/612 |
| 3,566,524 | A * | 3/1971 | Irasek et al. | G03B 21/115 221/134 |
| 3,841,637 | A * | 10/1974 | Piazza et al. | 273/141 A |
| 4,531,187 | A * | 7/1985 | Uhland | 463/12 |
| 4,667,959 | A * | 5/1987 | Pfeiffer et al. | 273/149 R |

(Continued)

*Primary Examiner* — John E Simms, Jr.
*Assistant Examiner* — Dolores Collins
(74) *Attorney, Agent, or Firm* — John S. Artz; Dickinson Wright PLLC

(57) ABSTRACT

A table game system for a game of chance includes a card shuffling machine for randomly selecting a single card from among a defined set of cards, the single card having indicia relevant to an outcome for the game of chance. The card shuffling machine is rotatable about an axis of rotation and includes a plurality of trays uniformly spaced about an outer periphery thereof. Each of the defined set of cards is located in a respective one of the plurality of trays. A card retrieval device is disposed adjacent the card shuffling machine and configured to at least partially remove the single card from its tray. A controller is in communication with the card retrieval device to effectuate engagement of the card retrieval device with the single card.

24 Claims, 9 Drawing Sheets

(56) References Cited

U.S. PATENT DOCUMENTS

| | | | | |
|---|---|---|---|---|
| 5,275,411 | A * | 1/1994 | Breeding | 273/149 R |
| 5,989,122 | A * | 11/1999 | Roblejo | 463/22 |
| 7,500,672 | B2 * | 3/2009 | Ho | 273/149 R |
| 7,719,424 | B2 * | 5/2010 | Steil | 340/572.4 |
| 7,753,374 | B2 * | 7/2010 | Ho | 273/149 R |
| 7,926,810 | B2 * | 4/2011 | Fisher et al. | 273/274 |
| 8,298,062 | B2 * | 10/2012 | Kido | 463/17 |
| 8,505,919 | B2 * | 8/2013 | Jones | 273/292 |
| 8,628,086 | B2 * | 1/2014 | Krenn et al. | 273/149 R |
| 8,777,727 | B2 * | 7/2014 | Jones | 463/22 |
| 9,757,641 | B2 * | 9/2017 | Jones | A63F 1/12 |
| 2003/0064798 | A1 * | 4/2003 | Grauzer et al. | 463/29 |
| 2005/0288089 | A1 * | 12/2005 | Cammegh et al. | 463/17 |
| 2008/0132316 | A1 * | 6/2008 | Fisher et al. | 463/17 |
| 2009/0124323 | A1 * | 5/2009 | Dunn et al. | 463/17 |
| 2013/0137501 | A1 * | 5/2013 | Jones | A61K 9/12<br>463/20 |
| 2013/0181401 | A1 * | 7/2013 | Jones | 273/138.1 |
| 2013/0307216 | A1 * | 11/2013 | Jones | 273/149 R |
| 2014/0246829 | A1 * | 9/2014 | Jones | 273/149 R |
| 2014/0256392 | A1 * | 9/2014 | Jones | 463/12 |
| 2014/0361484 | A1 * | 12/2014 | Jones | A63F 1/04<br>273/142 F |

* cited by examiner

AUTOMATED TABLE GAME SYSTEM

CROSS-REFERENCE TO RELEGATED APPLICATIONS

The present application claims priority to U.S. Provisional Patent Application Ser. No. 61/749,725, entitled "Automated Multi-Game Card Reading Apparatus", which was filed on Jan. 7, 2013, the disclosure of which is hereby incorporated by reference herein.

TECHNICAL FIELD

The present disclosure relates generally to an improved apparatus for randomly selecting a single card from among a set of cards in a game of chance. More particularly, the present invention relates to a wheel that is selectively rotatable about a central axis and which can be randomly stopped for selecting one playing card from among a set of cards that can then be automatically read to determine the outcome of the game of chance.

BACKGROUND OF THE INVENTION

Games of chance are well known activities whose outcomes are strongly influenced by randomizing devices and upon which contestants may wager money as they forecast outcomes. Common randomizing devices include dice, spinning tops, playing cards, roulette wheels, prize wheels, and numbered balls drawn from containers. Games of chance have been played throughout all of human history and are considered to be a popular pastime by many. Players of games of chance are attracted to new and exciting methods of game play as well as new and exciting randomizing devices. For this reason, the gaming industry is continuously developing new games and new randomizing devices to maintain player interest and attract new players.

Games of chance that include money wagers are typically regulated by governing authorities. These governing authorities enforce laws and regulations that are enacted to curtail certain kinds of games as well as certain kinds of randomizing devices. For example, in some jurisdictions, the use of dice or roulette wheels to resolve a game outcome, i.e., as the randomizing device, have been curtailed while other randomizing devices are permitted. Randomizing devices that use playing cards have been utilized more frequently as they enjoy fewer restrictions in games of chance played for money as compared to dice and roulette wheel randomizing devices.

While randomizing devices that employ cards have fewer restrictions, they generally still require some dealer involvement, which can have negative implications in some jurisdictions. For example, in some jurisdictions, the utilization of a live Dealer can impact how the game is characterized and therefore the requirements with which it must comply. This is because when live Dealers are involved, table game managers still must combat employee mistakes that cost the casino money (known as bleed). As casinos get busier and the tables get fuller, the decisions per hour that will be required by a live Dealer can decrease dramatically and the potential for bleed increases significantly. These factors can impact a casino's desire to carry a game.

Therefore, there is a desire within the gaming industry to develop new and interesting methods of game play and randomizing devices which utilize playing cards in unique and interesting ways and which can eliminate the need for live Dealer involvement and thus reduce bleed.

SUMMARY OF THE INVENTION

It is therefore an aspect of the present disclosure to provide a card randomizing device for a table game that significantly reduces labor costs for a casino.

It is another aspect of the present disclosure to provide a card randomizing device for a table game that minimizes the possibility of Dealer mistakes.

It is still another aspect of the present disclosure to provide a card randomizing device for a table game that eliminates bleed.

It is a further aspect of the present disclosure to provide a card randomizing device for a table game that provides increased security measures.

It is yet another aspect of the present disclosure to provide a card randomizing device for a table game that operates automatically without the need for a live Dealer.

In accordance with the above and the other aspects of the disclosure a table game system for a game of chance is provided. The table game system includes a card shuffling machine for randomly selecting a single card from among a defined set of cards. Each of the set of single cards includes indicia thereon that is relevant to the game of chance. The card shuffling machine is rotatable about an axis of rotation and includes a plurality of trays uniformly spaced about an outer periphery thereof. The plurality of trays are configured to receive the defined set of cards with a card being disposed in each tray. The system includes a card retrieval device that is disposed adjacent the card shuffling machine. The card retrieval device is configured to at least partially remove the single card from its tray to expose its indicia. The system includes a controller that is in communication with the card retrieval device to effectuate engagement of the card retrieval device with the single card.

BRIEF DESCRIPTION OF THE DRAWINGS

Other aspects of the present disclosure will be readily appreciated, as the same becomes better understood by reference to the following detailed description when considered in connection with the accompanying drawings wherein.

DETAILED DESCRIPTION OF THE DISCLOSURE

Figure 1:
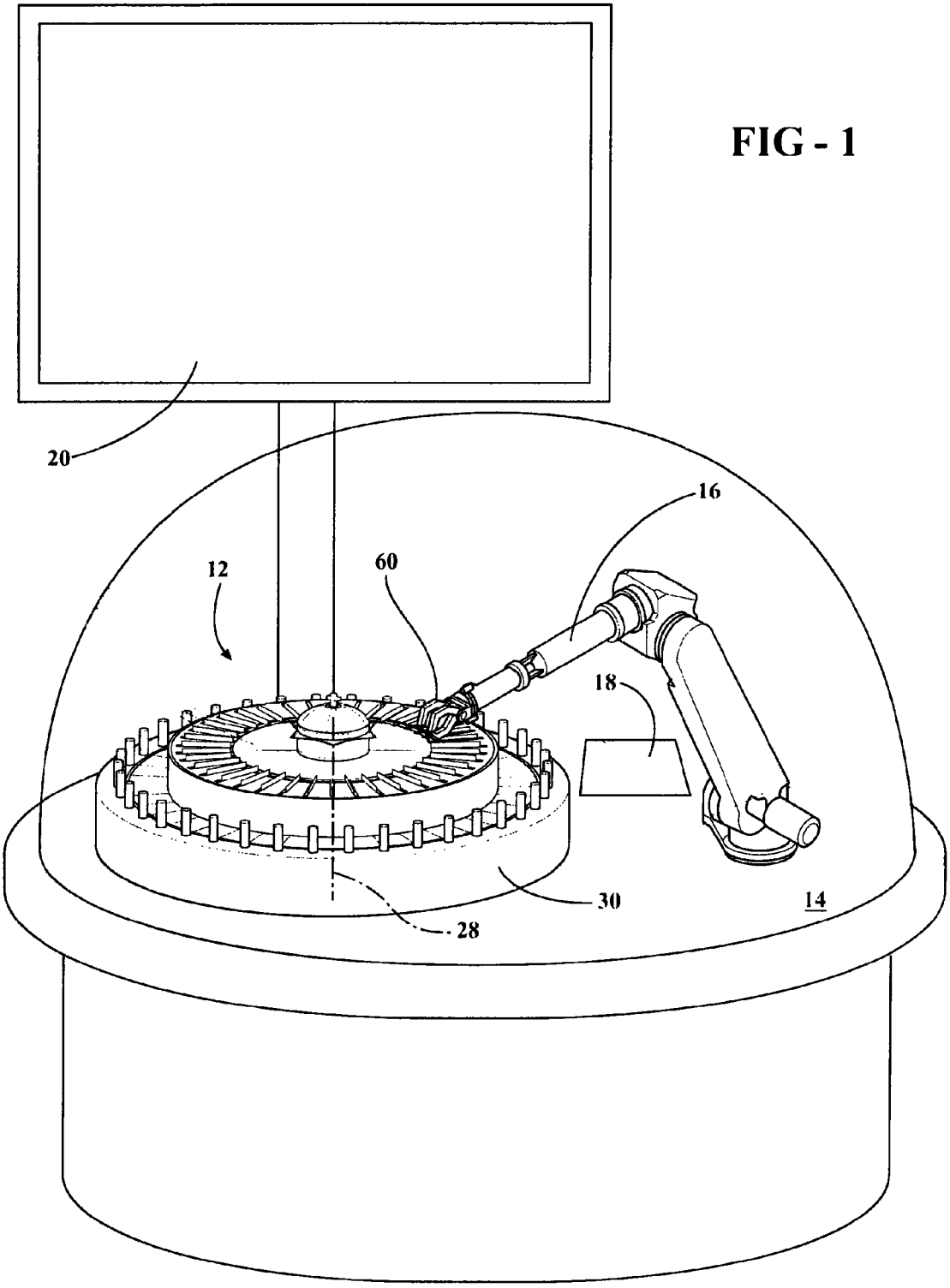
FIG. 1 is a perspective view of a table game system including a card randomizing device according to an aspect of the disclosure.

Referring now to the Figures, the present disclosure relates to a table game system 10 including a random number generator. In accordance with an aspect, the random number generator may be a card randomizing device or shuffling machine 12. Other randomizing devices, including other suitably configured card randomizing devices may also be employed. According to another aspect, the card shuffling machine 12 can select or identify a single card for use in connection with a game of chance, such as for determining an outcome. According to an aspect, the card can then be automatically removed from the shuffling machine and then automatically read to determine the outcome of the game. Utilization of an automated system can allow for the elimination of live Dealer input and thus any resulting Dealer errors that can cause bleed.

As shown, according to a further aspect, the table game system 10 may include a table 14 on which the card shuffling machine 12 may be disposed, a card retrieval device 16, a card reader 18 and a display screen 20. According to an aspect, the card shuffling machine system 12 rotates and then is stopped to randomly select a single card relevant to the game outcome. The selected card can then be placed in proximity to the card reader 18 which may read the selected card to obtain the relevant selected card information, such as its indicia. According to an aspect, the card reader 18 may be an RFID card reader, as discussed in more detail below. Alternatively, other suitable electronic reading devices may be used to obtain the relevant information about the card such that it can be input into a suitably programmed electronic game server or computer 22 configured to execute the game being played. According to another aspect, other mechanism for identifying the selected card may be employed. The results of the game and/or other information may be displayed on the display screen 20 associated with the game system 10 so that it is visible to the players as well as bystanders.

Figure 2:
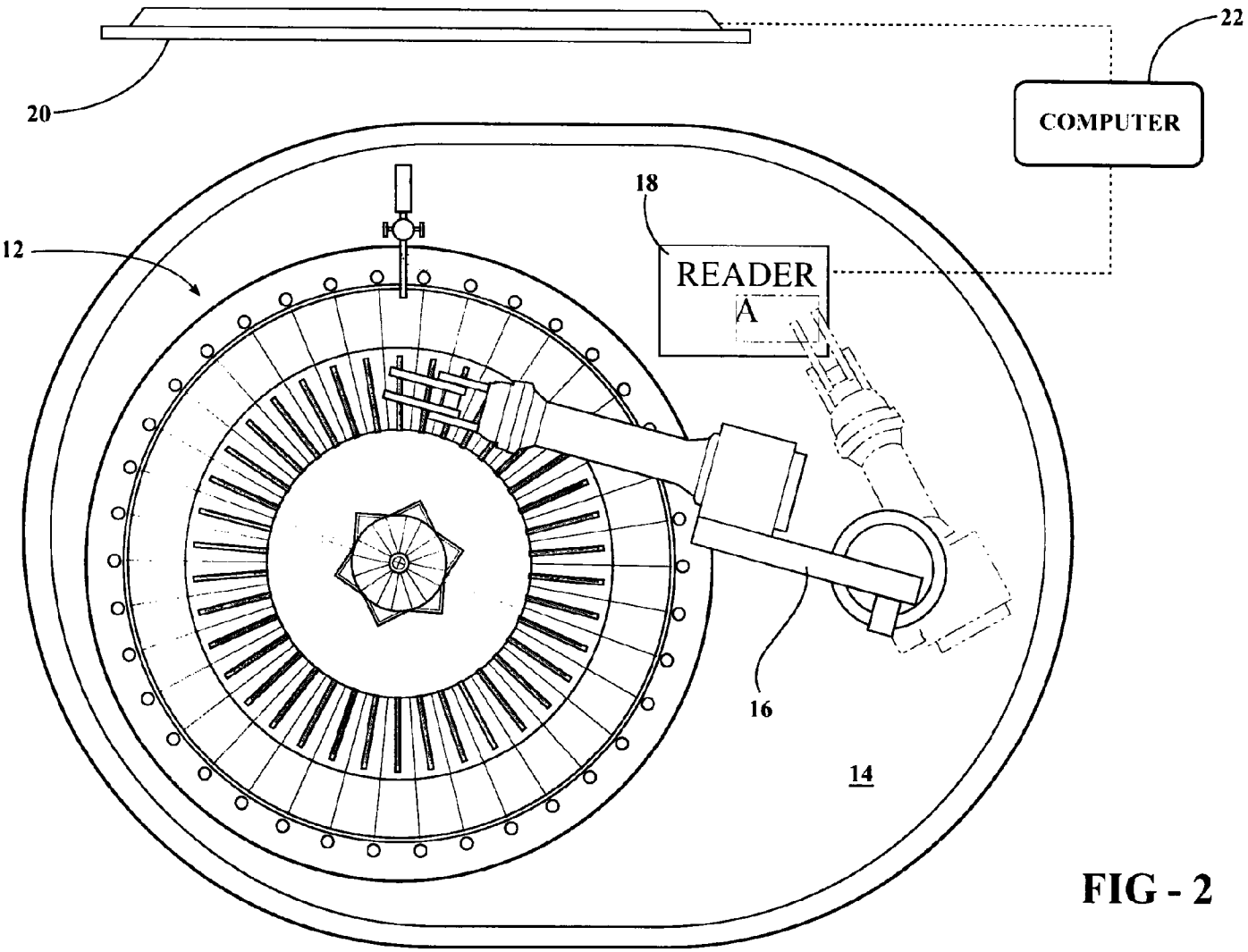
FIG. 2 is top view of a table game system including a card randomizing device according to an aspect of the disclosure.
Figure 3:
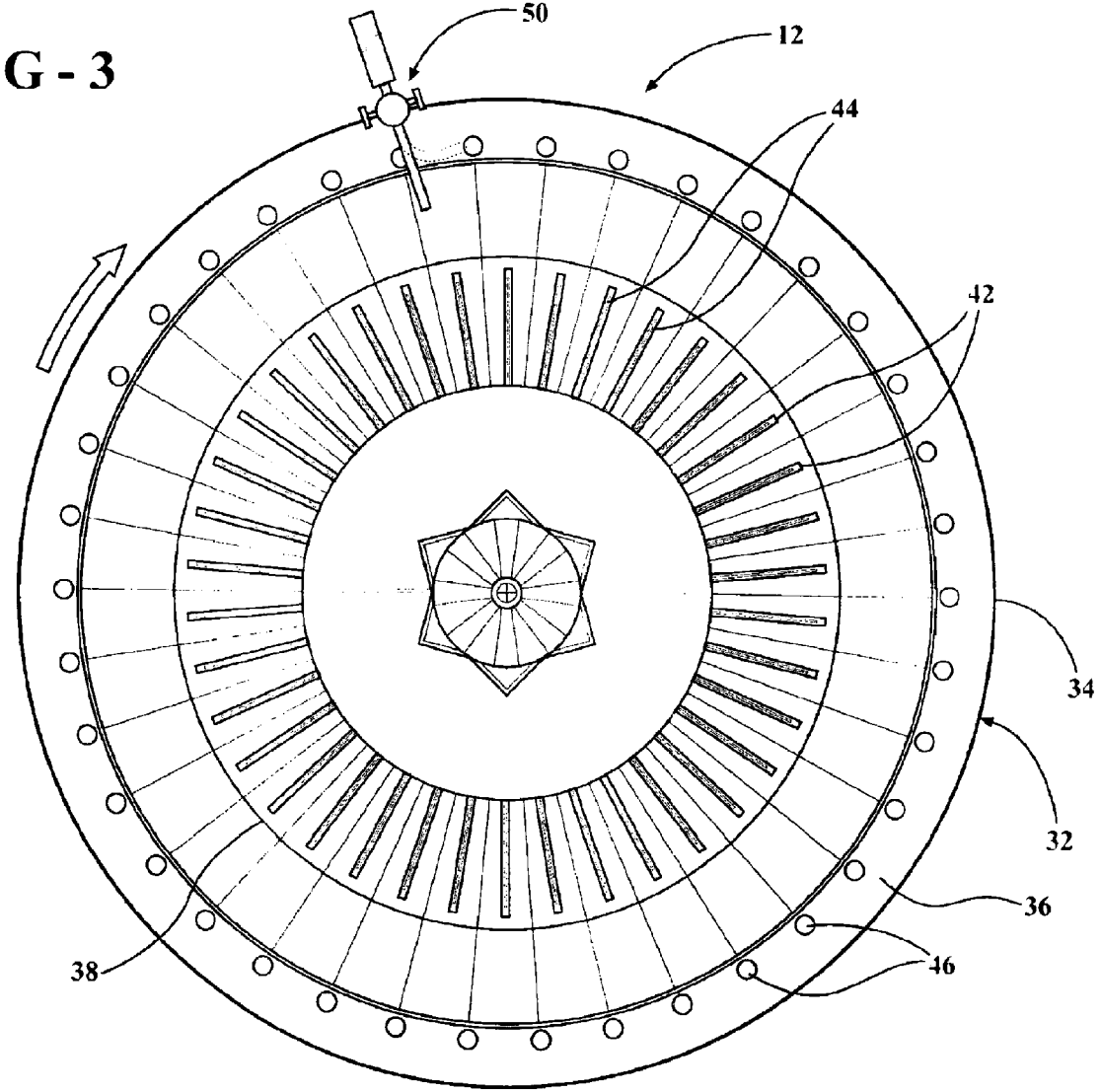
FIG. 3 is a top view of a card randomizing device for a table game system according to an aspect of the disclosure.

With reference to FIGS. 1 through 3, the shuffling machine 12 can randomly select a single card from among a set of cards. According to an aspect, the shuffling machine 12 may be in communication with the computer 22 so that the shuffling machine 12 can be operated automatically, i.e. without the need for manual interaction by a live Dealer. As shown, the shuffling machine 12 may include a stationary base 30 which is effective to establish a generally vertical central axis A. In accordance with one aspect of the disclosure, the base 30 is shown as a squat, generally cylindrical member. However, this configuration can be varied as desired. A turntable 32 may movably be supported above the base 30 for free rotation within a generally horizontal plane about the central axis A. The turntable 32 may have a generally circular outer periphery 34, and, according to this aspect, is configured with multiple levels forming a hat-like construction. More specifically, an outer rim section 36 may be circumscribed by the outer periphery 34 and rest directly above the stationary base 30. An elevated stage section 38 which may be secured to the turntable 32 may be centrally located therein. A decorative crown piece 40 may be affixed centrally within the stage section 38 for purely aesthetic purposes. It will be appreciated that the card shuffling machine 12 may have a variety of suitable configuration.

According to an aspect, the stage section 38 of the turntable 32 can include a plurality of trays 42. In one example, the defined plurality of trays 42 may consist of exactly thirty-eight trays. Depending upon the game of chance to be played, however, the defined plurality of trays 42 can be varied to include more than or less than the exemplary thirty-eight trays illustrated here. The trays 42 can be equally circumferentially spaced apart one from another about the central axis A. In other words, in this exemplary aspect where thirty-eight trays 42 are provided, each tray occupies a sector of approximately 9.47 degrees. If the number of trays 42 were decreased to thirty-six, for example, each tray 42 would occupy a sector of exactly 10 degrees, and so forth. The trays 42 may, as shown in the FIGs, comprise narrow slots arranged along radials extending from the central axis A. Each slot may be sized, shaped and oriented so as to hold a single playing card 44 in a vertically upstanding orientation. It will be appreciated that the configuration of the slots and trays may vary. Also, the cards can be retained in the slots a variety of other suitable ways and in a variety of different orientations. It will be appreciated that the cards may be disposed on the turntable in other ways or arrangements.

Figure 6:
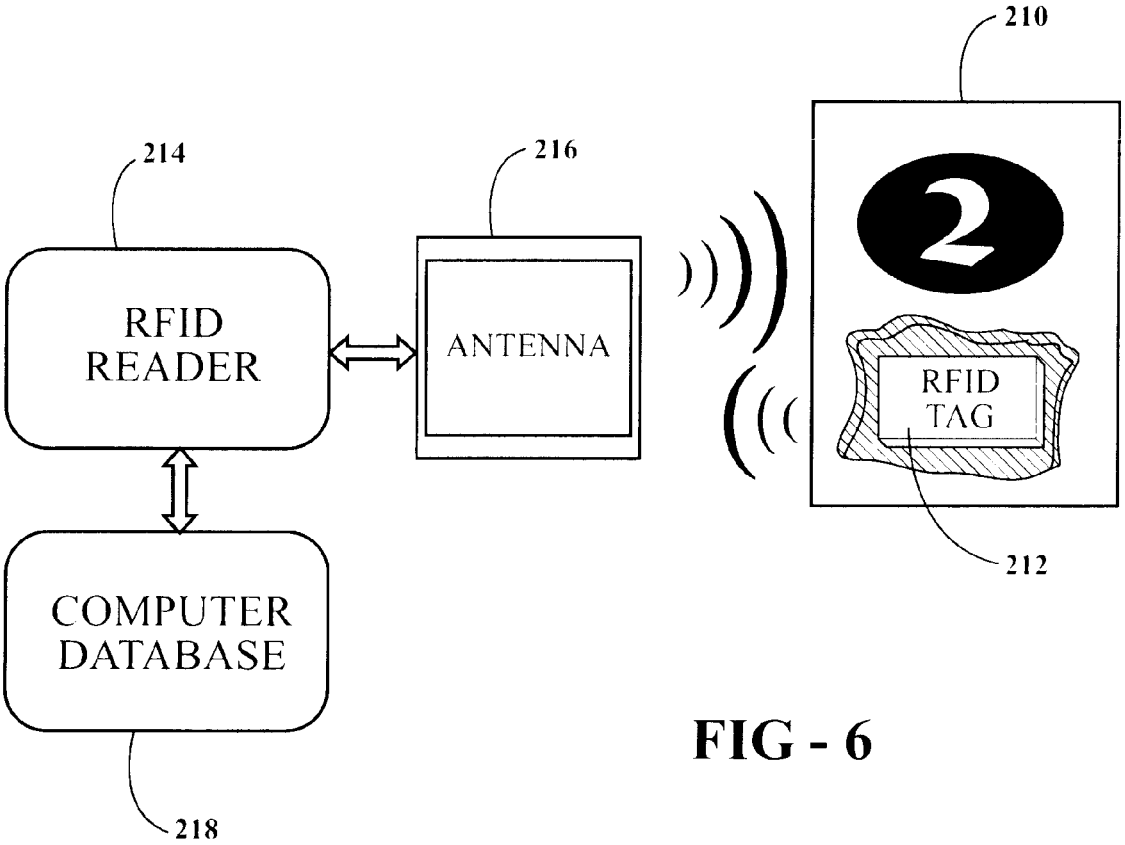
FIG. 6 is a schematic diagram illustrating a method of reading an identified playing card in accordance with an aspect of the disclosure.
Figure 7:
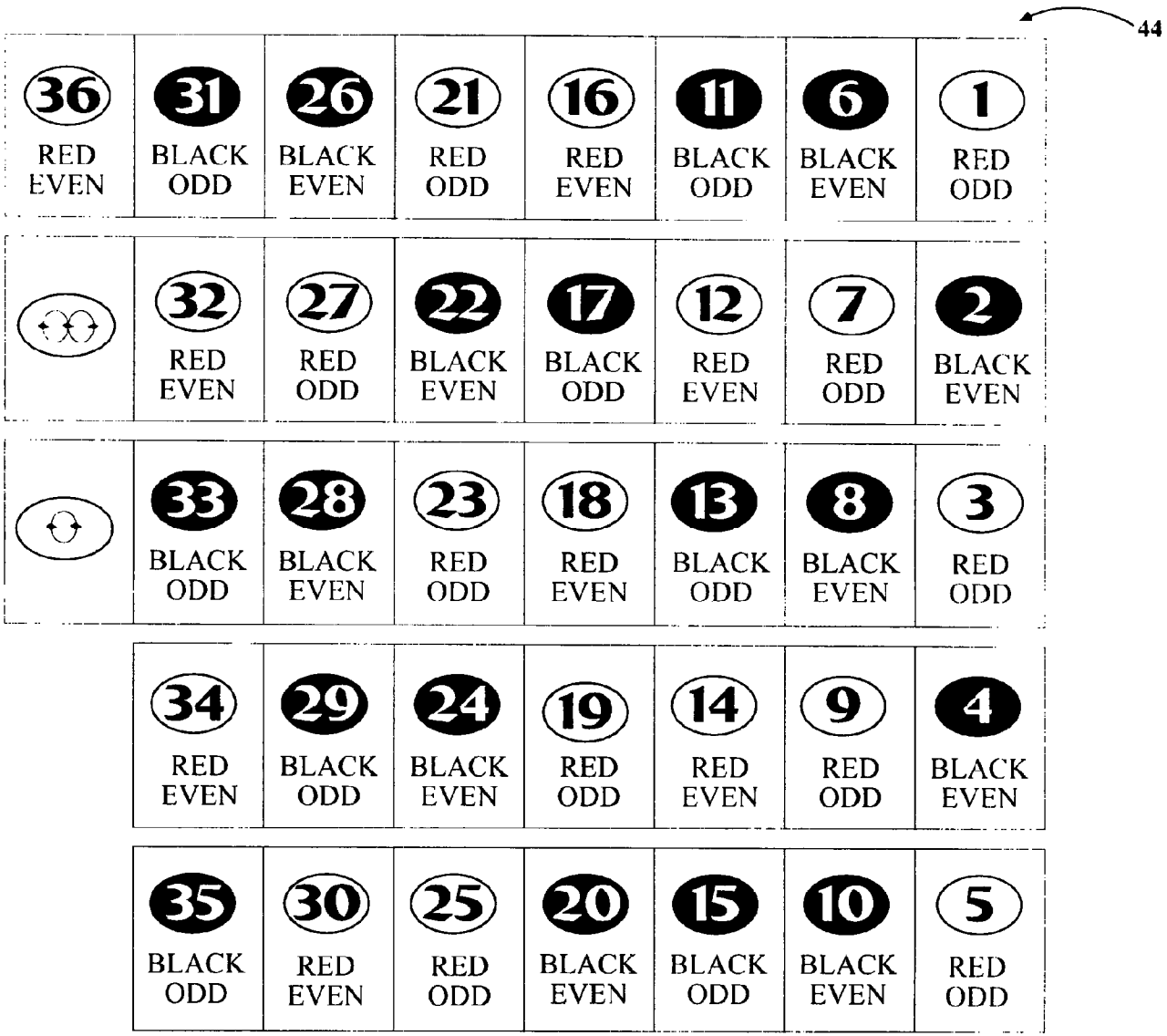
FIG. 7 is a schematic illustration of the front sides of a set of playing cards in accordance with an aspect of the disclosure.
Figure 8:
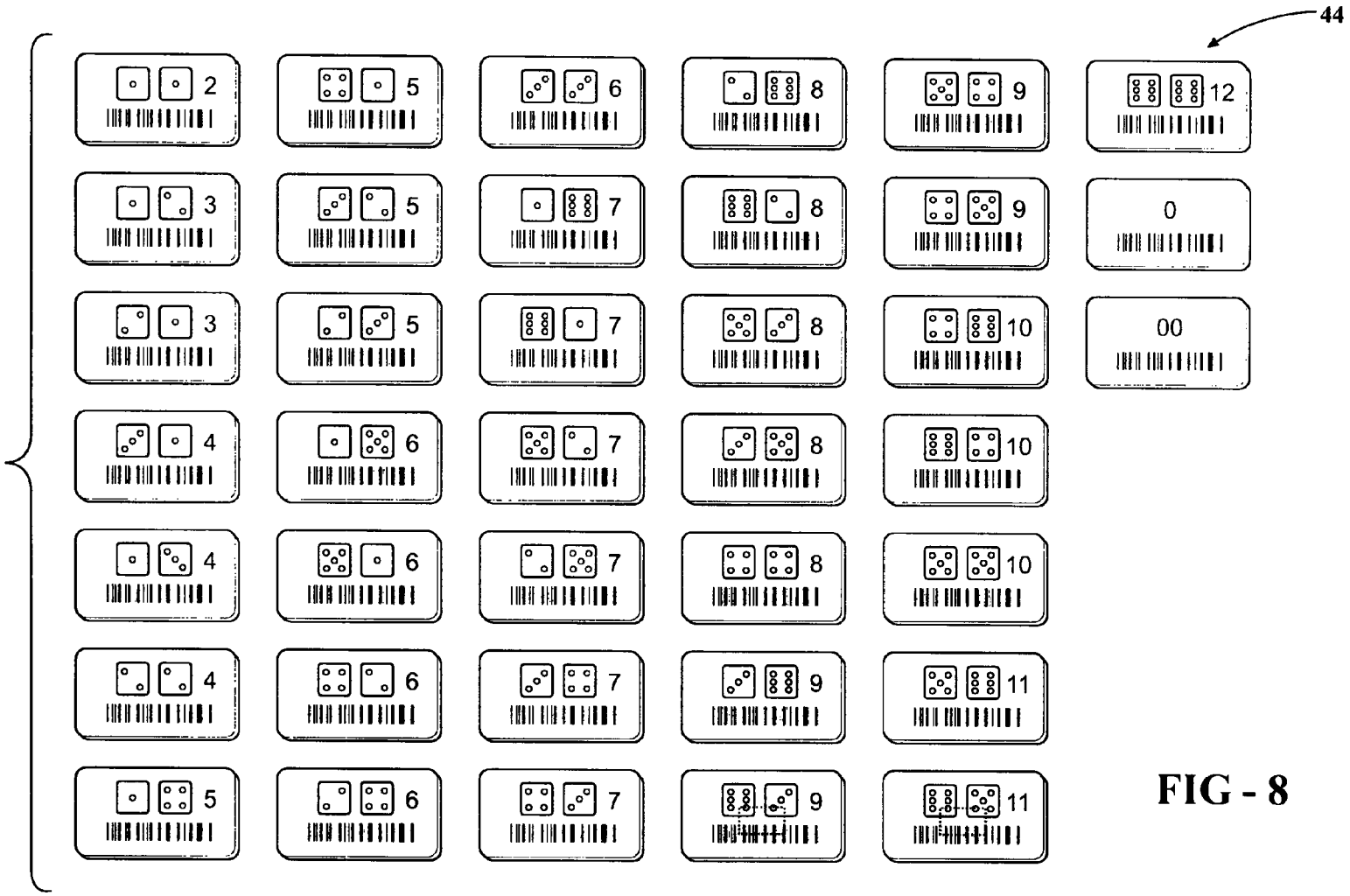
FIG. 8 is a schematic illustration of the front sides of a set of playing cards in accordance with another aspect of the disclosure.

According to an aspect, the cards 44 used in the shuffling device 12 may be dimensionally similar to those used for playing card games like poker, blackjack and the like. Alternatively, instead of the traditional rectangular configuration, the cards 44 may be shaped in other interesting or effective geometries. In accordance with one example, a set of cards 44 can be equal in number to the defined plurality of trays 42. Thus, in keeping with the previously proposed example of thirty-eight trays, a set of cards could consist of thirty-eight distinct cards with different indicia. FIGS. 6 through 8 illustrate exemplary cards according to an aspect where the game of chance is roulette. It will be appreciated that the cards may be configured for other games, as discussed below, and more or less cards may be employed as necessary.

According to an aspect, the trays 42 may be arranged so as to hold each card 44 so that its long edges are oriented horizontally, and its short edges are oriented vertically. According to another aspect, the depth of each slot in the trays 42 can be less than the narrow width of each card 44, so that a noticeable, protruding portion of each card 44 can extend above the stage section 38 of the turntable 32. This protruding portion may allow the card 44 to be easily removed from its tray 42 by the card retrieval device 16, as discussed in more detail below. Thus, each card 44 may be loosely contained in its respective tray 42 without the use of fastening devices, spring clips, or any other fixation medium.

According to an aspect, each card 44 may bear indicia related to a decision for a game of chance. Almost any of the known games of chance can be played using the system 10 and the card shuffling machine 12 of this disclosure, so long as the number of cards 44 and the number of their represented indicia result in a probability of decision which is equivalent to the traditionally played game. For example, it is possible to play a game of chance which conforms substantially to the traditional rules of roulette using cards 44 bearing indicia substantially as depicted in FIG. 7. There, it is illustrated that thirty-six cards are marked with distinct indicia selected from the group consisting of the whole numbers 1 to 36. Also in keeping with the traditional rules of roulette, eighteen of the cards may be marked with the color red indicia, while eighteen different cards are marked with the color black indicia. This corresponds to the red and black colors used in traditional roulette. Two additional cards may be colored with the green indicia and marked 0 and 00, respectively. When arranged in the trays 42, the card shuffling machine 12 enables any one of these cards 44 to be selected from the set of cards, and its particular indicia used to decide the game of chance.

In another example, the card shuffling machine 12 of this disclosure can be used to play a game according to the traditional rules of craps. The randomizing device used in the traditional game of craps typically consists of a pair of six-sided dice with each side of the dice bearing a dot representative of the whole numbers 1 to 6. Considering the pair of dice together, thirty-six possible combinations can be achieved by the two dice. Accordingly, as shown in FIG. 8, the set of cards 44 may be marked with indicia representing the whole numbers 2 to 12 in the following combinations: one number 2, two number 3's, three number 4's, four number 5's, five number 6's, six number 7's, five number 8's, four number 9's, three number 10's, two number 11's, and one number 12. These cards may also be imprinted with indicia which pictorially represent all thirty-six available combinations of a pair of six-sided dice. When arranged in a turntable 32 consisting of thirty-six equally spaced trays 42, complete odds parity with the traditional game of craps can be achieved through use of the disclosed card shuffling machine 12. To add variety to the traditional game of craps, one or two additional cards bearing the indicia 0 and 00 can be added. Likewise, other games of chance can be played using the disclosed card shuffling machine 12 as the randomizing device. Such games may include blackjack, war, and many others.

According to still a further aspect, the rim section 36 of the turntable 32 may be provided with a plurality of dividers 46. The plurality of dividers 46 may be equal in number to the defined plurality of trays 42. Thus, in the exemplary embodiment where thirty-eight trays are provided, the number of dividers 46 is also thirty-eight. The dividers 46, like the trays 42, may also be spaced one from another in equal circumferentially-spaced increments about the central axis A. Thus, if the trays 42 can also be spaced one from another 9.47 degrees, the dividers 48 can likewise be spaced one from another 9.47 degrees. Accordingly, the space between each divider 46, as measured from center-line to center-line, occupies a sector equal to 9.47 degrees, or whatever accurate measure is achieved when the number 360 is divided by the number of dividers 46. Preferably, although by no means necessarily, the dividers 46 may be oriented so as to perfectly bisect the angular sector between each adjacent tray 42. Put another way, a radial extending from each divider 46 to the central axis A is preferably, but not necessarily, offset from the center-line of each adjacent tray 42 by an angular measure equal to the total number of trays 42 divided by 720. In this manner, the space or gap between each divider 46 may be exclusively associated with one specific tray 42. It will be appreciated that other arrangements may be employed.

According to another aspect, a detent 50 can be fixed relative to the base 30, which and operatively interact with the dividers 46. The detent 50 may function to apply a pulsating resistance to the free rotation of the turntable 32 and thereby progressively slow the turntable 32 to a stopped condition relative to the base 30. According to an aspect, the detent 50 may comprise a resiliently flexible tongue 52 supported in a retractable clamping holder 54 so that the tongue 52 can be withdrawn from the movement path of the dividers 46. In this example, the dividers 46 comprise upstanding pegs which are fixed to the rim section 36 of the turntable 32 at exactly equally radially spaced measurements from the central axis A. It will be appreciated that the dividers can take on a variety of different configurations. Thus, after the turntable 32 has begun rotating in the direction of the arrow in FIG. 3 as initiated by the computer 22, the tongue-like detent can be automatically moved to a position that interferes with the paths of the dividers 46 under computer control. It will be appreciated that a live Dealer may also be utilized to start rotation of the turntable 32.

Alternatively, the detent 50 could remain in contact with the turntable 32 at all times. In accordance with still another aspect, the detent 50 could be manually moved into and out of communication with the turntable 32. When spun forcefully, the angular momentum of the turntable 32 is sufficient to deflect the detent 50 out of the way in a flipper-like fashion typical of prize wheel type randomizing devices known in the prior art. The tongue 52 of the detent 50 may be made of a felt-like material, or other suitable material, such as an elastic material. Each sequential impact and deflection of the detent 50 caused by the rotating dividers 46 results in a pulsating resistance which slows the turntable 32 and eventually brings it to a complete stop. The location or tray which the detent points to when the turntable 32 stops could be used to identify the selected card.

In accordance with still another aspect, the turntable 32 need not utilize any detent 50. According to this aspect, the turntable 32 may be automatically spun as initiated by the computer 22. Once all the wagers have been made, the computer could be configured to send a signal to shut down the rotation of the turntable 32 such that it slows down and eventually stops. The selected card may be the one that resides in a pre-designated area of the turntable 32.

According to an aspect, the system 10 can include a card retrieval device 16, such as a mechanical arm, that may be configured to move with respect to the table 14 and the shuffler 12. As shown, the mechanical arm could have a base portion, as well as a first arm portion that is connected to a second arm portion by an elbow. This configuration could allow the arm to move through various degrees of freedom to perform the functions described herein. In accordance with another aspect, when the shuffler 12 comes to rest and a single card 44 has been selected by coming to rest within the designated area, the card retrieving device 16 can automatically move to a position over the selected card as generally shown in FIGS. 1 and 2 as controlled by the computer 22. A card grasper 60 may be disposed on an end of the card retrieval device 16 to grasp the card 44 and remove it from the tray 42. The card grasper 60 may be configured to remove the card from the tray. For example, it may be configured as a mechanical gripper that clamps the card and lifts it from the tray 42. Alternatively, the grasper 60 could be a magnet that communicates with a magnet on the card to remove the card from the tray. Other suitable mechanism for grasping, lifting, or removing the card could also be employed. According to an aspect, after the card retrieval device 16 has removed the card 44 from the tray 42, the card retrieval device 16 can move the card into communication with the card reader 18 so that its information can be obtained as generally shown in phantom lines in FIG. 2. In accordance with one example, the card retrieval device 16 can be disposed on top of the table 14. Alternatively, the card retrieval device 16 may be disposed beneath the table to minimize the amount of space required for the system 10. The card retrieval device 16 could be disposed in other locations and take on a variety of other suitable configurations. Once the information about the card 44 has been obtained by the card reader 18, the card retrieving device 16 can return the card 44 back to the tray 42. Once the game is over and all wagers have been settled, the shuffler 12 can begin another cycle. The operation of the card retrieval device 16 may be fully automated as controlled by a program executed by the computer 22, such as through a controller that may be separate from or part of the computer.

According to an aspect, the system 10 may include a transparent housing 62 that encloses and covers the shuffler 12, the card retrieval device 16 and the card reader 18. The housing 62 may be formed of plastic material. Alternatively, other suitable materials such as glass may also be utilized to form the housing 62. The housing 62 may be configured as a dome or sphere that allows for easy visibility to the shuffler 12 as the game is ongoing. The housing 62 can obviously have a variety of other suitable shapes, sizes and configurations. The housing 62 may fully enclose the shuffler 12 and the card reader 18 or it may have an opening that allows access to these components.

Figure 4:
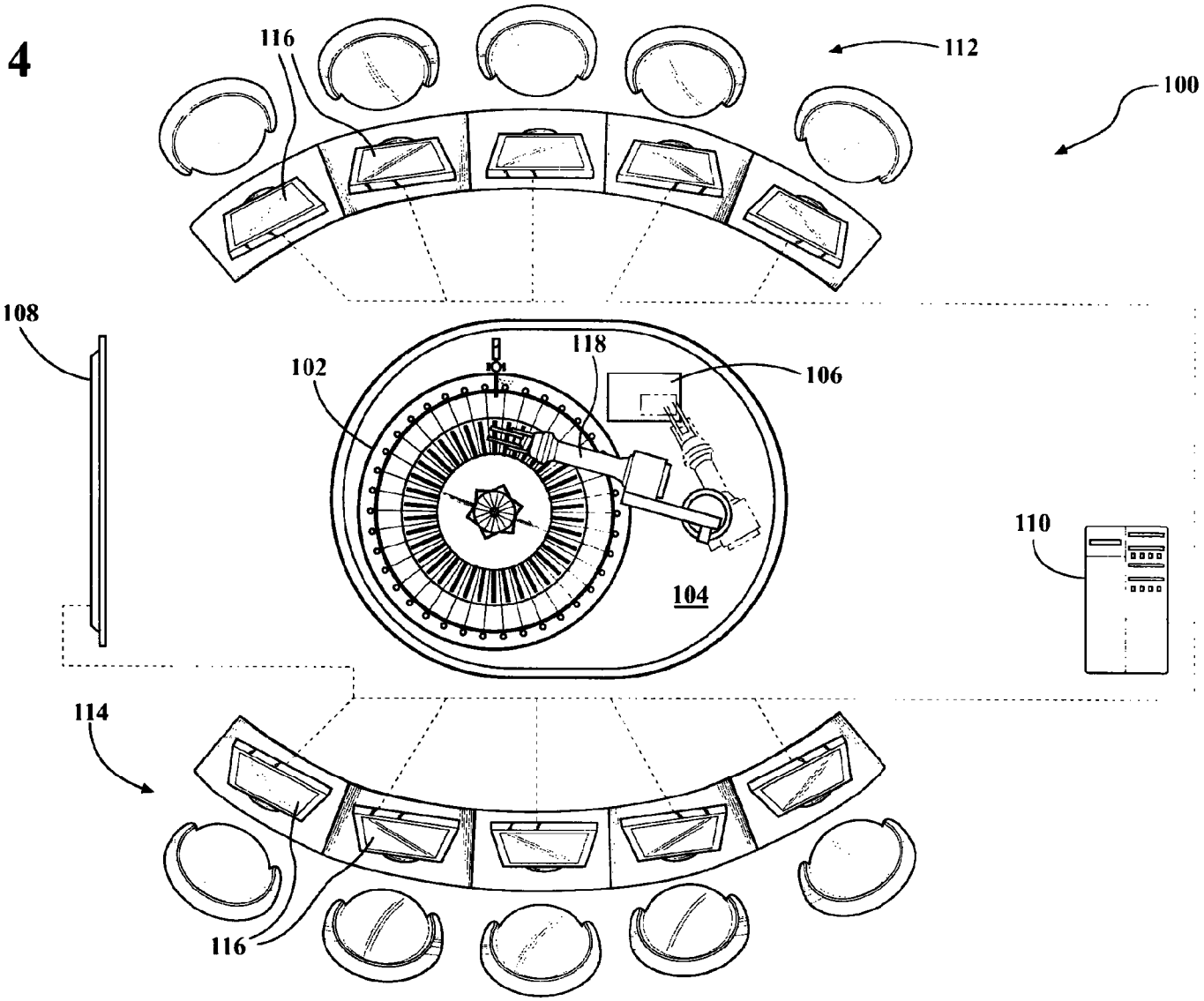
FIG. 4 is a schematic illustration of a table game system employing a card randomizing device and including player terminals according to an aspect of the disclosure.

FIG. 4 illustrates a table game system 100 in accordance with another aspect of the present disclosure. As shown, according to this aspect, the table game system 100 can include a shuffling machine 102 disposed on a table 104. The shuffling machine 102 can select a single card from a full set of cards. The system 100 may also include a card reader 106 and a display screen 108. According to another aspect, the system 100 may operate entirely under the control of a computer 110. It will also be appreciated that a live Dealer could be utilized to monitor the system, but is not necessary. According to a further aspect, the system 100 can include a first group of player terminals 112 and a second group of player terminals 114. Each of the groups of player terminals 112, 114 can include a plurality of individual terminals 116. At the terminals 116, players can monitor the game being played, place wagers on the outcome of the game and receive winnings. In accordance with other aspects, the players may be afforded other options and features at the terminals 116. The terminals may be equipped to allow players to insert money, credit cards, tickets or other monetary consideration to allow players to make wagers at the terminals.

The system 100 also can include a card retrieval device 118 that allows the selected card to be retrieved from the shuffling machine 102 and then moved into communication with the card reader 106 under computer control. Specifically, the computer 110 may include a controller for controlling operation of the card retrieval device 118. According to an aspect, the card reader 106 may be an RFID reader that communicates with an RFID reader tag in the selected card. Other suitable readers and reading technology may be employed, such as NFC or video. According to an aspect, once the card has been read, the information read from the card may be transmitted by the card reader 106 to the computer 110 for processing. The identity of the card can then be displayed on the screen 108 as well as on each of the individual terminals 116. The computer 110 may then automatically resolve all bets at the player terminals 116. Preferably, the card displaying device 118 can then replace the card in the empty try in the shuffler 102. According to a further aspect, the shuffler 102 and the card reader 106 can also be disposed within a protective housing 120. It will be appreciated that the table 104 may include wagering areas that allows players to make wagers on the outcome of the game without use of a terminal. According to an aspect, the system 100 is fully automated and may operate entirely without the assistance of a live dealer.

Figure 5:
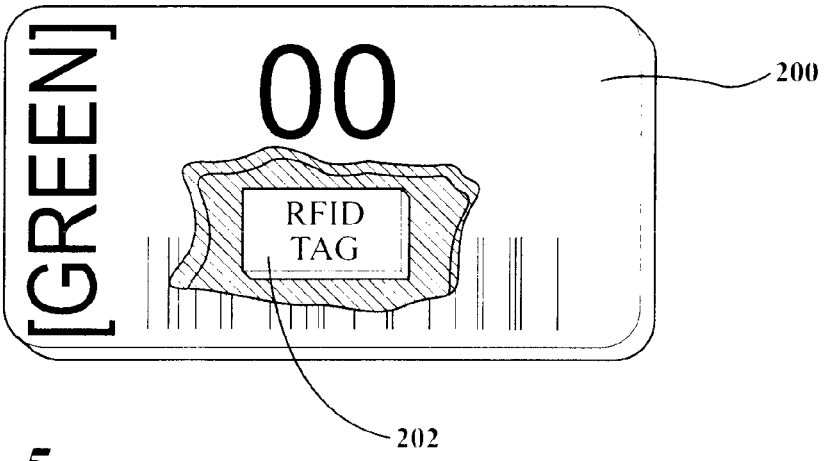
FIG. 5 is a schematic illustration of an exemplary playing card in accordance with an aspect of the disclosure.

FIG. 5 illustrates a card 200 bearing indicia related to a decision for a game of chance. According to an aspect, this exemplary card 200 reflects one of the numbers or results associated with the game of roulette. As shown, the card 200 bears indicia for the number "00" and the color green. According to an aspect, the card 200 also includes an RFID tag 202 associated therewith. According to another aspect, the RFID tag may be embedded in the card 200. As will be understood, the RFID tag 202 contains the information about the card indicia stored thereon, i.e., color and number.

FIG. 6 schematically illustrates the steps of reading a card 210 according to an aspect of the disclosure. As shown, the card 210 bears indicia related to the game of roulette, specifically the number 2 and the color black. An RFID tag 212 may be associated therewith that includes information stored thereon about the card indicia. When the card 210 is brought into proximity with an RFID card reader 214, which includes a wireless antenna 216 to communicate with the RFID tag 212, the RFID card reader 214 can read the information about the card that is stored on the RFID tag 212. The information may then be transmitted to a computer 218 so that it can be utilized to settle wagers and display the card indicia on the monitors and terminals.

Figure 9:
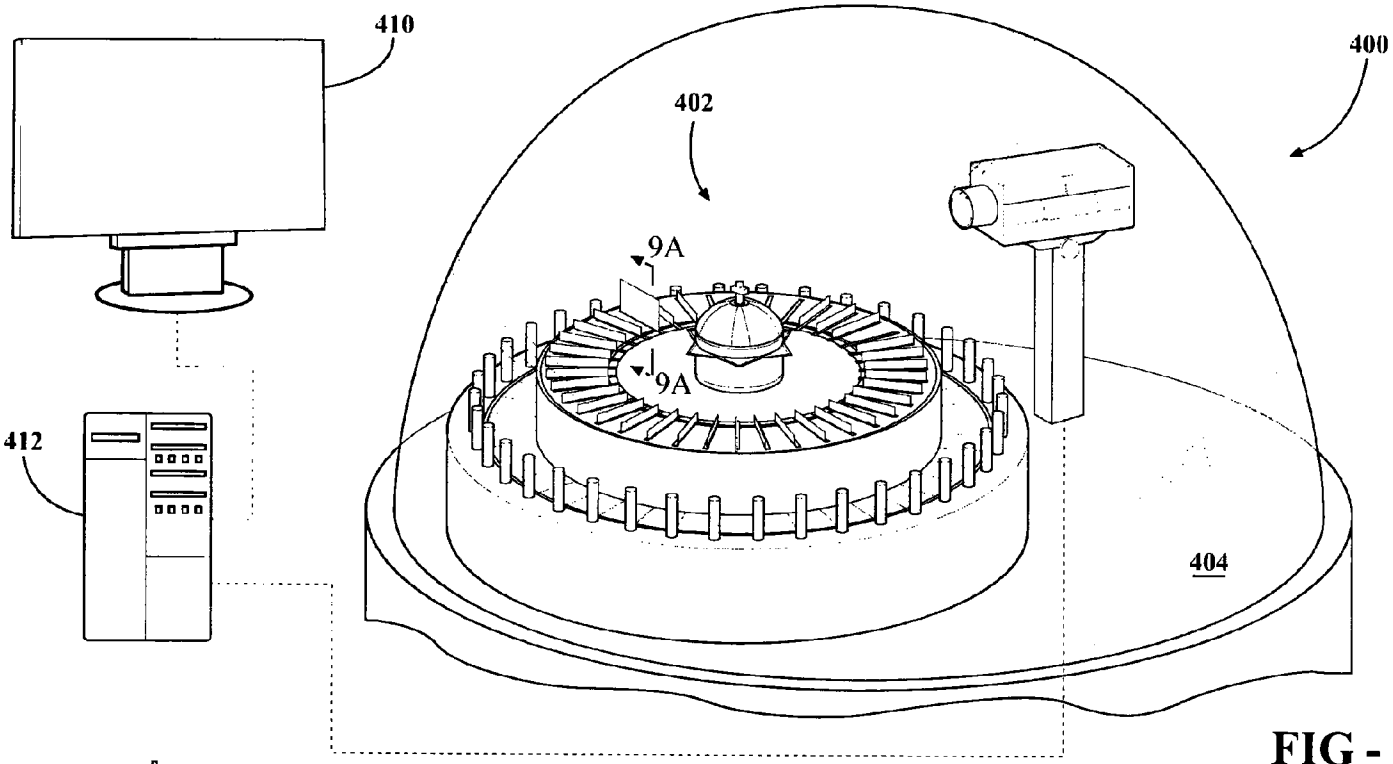
FIG. 9 is a schematic illustration of a table game system, including a card randomizing device in accordance with another aspect of the disclosure.
Figure 9A:
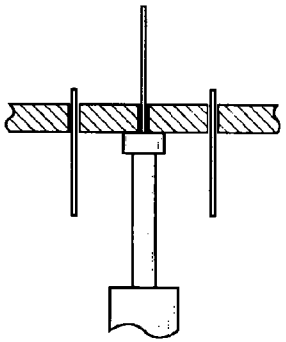
FIG. 9A is a broken away cross-sectional view of a card retrieval device along the line 9A-9A in FIG. 9.

Referring now to FIG. 9, another aspect of the disclosure is shown. According to this aspect, a table game 400 is disclosed having a card randomizing device or shuffler 402, a table 404 on which the card shuffler 402 may be disposed, a card retrieval device 406, a card reader 408, a display screen 410 and a computer 412. In accordance with this aspect, the card retrieval device 406 can consist of a plunger or push-rod that is disposed beneath the surface of the cards such as schematically shown in FIG. 9A or other suitable structure for lifting the card. When the turntable stops rotating, a single card is selected and the plunger located beneath the selected card may be actuated and the selected card may be raised at least partially out of its tray. It will be appreciated that the plunger of FIG. 9 could be utilized with the card retrieval device 16 of FIGS. 1 through 3 to assist in lifting the card for grasping.

According to this aspect, the card reader 408 can be a bar code scanner that can read a bar code on the elevated card. A bar code may be located on each card and includes the indicia about the card in readable form, i.e. color and number. Instead of a bar code scanner, the reader could be a video camera that takes a picture of the indicia. Regardless of the type of reader employed, the card retrieval device 406 must lift the card high enough out of its respective tray so that it can be read. Once the card indicia is read, the information can be transmitted to the computer 412 and then displayed on the screen 410. The computer 412 can then resolve any wagers. The raised card can then be returned to its tray by lowering the plunger. Alternatively, instead of a scanner, the card reader 408 could be a video camera that can display an image of the selected card after it is raised. By this method, players of the game of chance can reliably see the indicia of the selected card and thereby be assured that the correct game decision has been announced.

Through use of the systems of the various aspects as described herein, electronic posting of the drawn card flows through both a reader board and game processing software to add speed, certainty and enjoyment to the game play. Of course, other card reading formats and card recognition techniques may be employed with, or without, any visible markings on the cards.

The turntable can be made conveniently separable from the base so that a different turntable having a different number of trays can be substituted to play different games. Thus, the subject card shuffling machine is readily adaptable from one game method to the next. Although not illustrated in the FIGS., the sector of the stage section which is occupied by each tray may be colored, for example red or black, to correspond with coloring indicia provided on its associated card. Other color and decorative variations may also be imposed depending on taste and application. Furthermore, the overall configuration of the turntable can be varied greatly for stylistic reasons, without departing from the spirit or scope of this invention.

Figure 10:
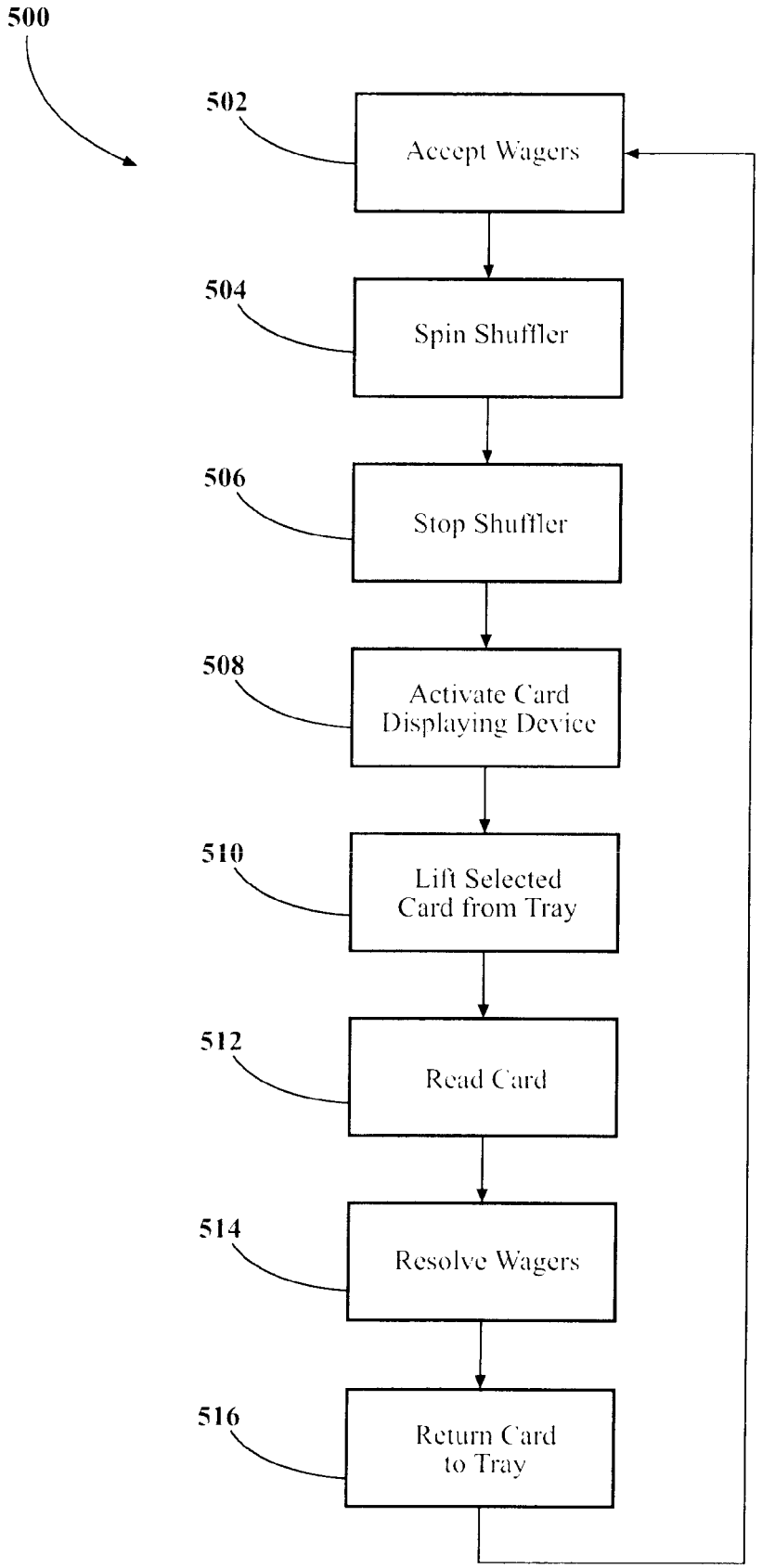
FIG. 10 is a schematic diagram illustrating the operation of a table game system in accordance with an aspect of the disclosure.

FIG. 10 is a simplified flow chart illustrating the operation of the system 500 in accordance with an aspect of the disclosure. As shown, according a first step, wagers are placed at the individual terminals and accepted by the computer, as generally depicted by reference number 502. Next, the shuffler is spun automatically under computer control, as designated by reference number 504 and the detent 50 may be placed into engagement with the turntable 32. Alternatively, the shuffler can continue to spin while wagers are being made. Thereafter, the computer may randomly stops the turntable as generally indicated by reference number 506 such that a single card is randomly selected.

Once the shuffler has stopped, the card retrieval device may be automatically activated to remove the card from its tray, as generally reflected by reference number 508. The card retrieving device may raise the card from the tray, as generally designated by reference number 510. The card may then read such as by an RFID device, bar code scanner, video or the like, as indicated by reference number 512. The information on the card may then be transmitted to the computer and all wagers may be automatically resolved as indicated by reference number 514. The card is then returned to the tray as indicated by reference number 516 by the card retrieval device. The system then resets such that the game can be played again and the steps are repeated.

In situations where wagers are resolved at each game console, as in ticket in-ticket out (TITO) and other such systems, there is no requirement for a dealer or game operator to handle chips, tokens or cheques.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

The invention claimed is:

1. A table game system for a game of chance, comprising:

a card shuffling machine for use with a table game of chance, the card shuffling machine being disposed adjacent a table game surface and capable of randomly selecting a single card from among a defined set of playing cards, the defined set of playing cards each having indicia relevant to an outcome for the game of chance;

the card shuffling machine being rotatable about an axis of rotation and including a plurality of trays uniformly spaced about an outer periphery thereof, each of the plurality of trays being configured for receiving one of the defined set of playing cards;

a card retrieval device disposed adjacent the table game surface to engage the selected single card to at least partially remove it from its tray such that indicia of the selected single card can be visually displayed;

a controller in communication with the card shuffling machine and the card retrieval device, the controller adapted to automatically effectuate rotation of the card shuffling machine about the axis of rotation and to direct the card retrieval device to effectuate engagement with the selected single card and at least partially remove the selected single card from its tray upon the card shuffling machine ceasing rotation; and the card retrieval device being operable to return the selected single card to its tray.

2. The table game system of claim 1, further comprising:

a card reader for capturing the indicia of the single card after being at least partially removed from its tray.

3. The table game system of claim 2, wherein the card retrieval device consists of a mechanical arm that is capable of grabbing the single card and removing it from it from its tray and transport the single card into communication with the card reader.

4. The table game system of claim 2, wherein the card retrieval device is disposed beneath the plurality of trays for pushing the single card upward so that its indicia may be exposed above its tray.

5. The table game system of claim 4, wherein the card retrieval device is a push rod.

6. The table game system of claim 2, wherein each of the defined set of cards includes a unique RFID tag associated therewith, which contains the card indicia information; and wherein the card reader is an RFID reader that is adapted to read the RFID tag associated with the selected card to obtain the card indicia information.

7. The table game system of claim 2, wherein each of the defined set of cards includes a unique bar code associated therewith, which contains the card indicia information; and wherein the card reader is a bar code reader that is adapted to read the bar code associated with the selected card to obtain the card indicia information.

8. The table game system of claim 2, wherein the card reader is a video camera that obtains the card indicia information.

9. The table game system of claim 1, wherein the outcome of the game of chance is determined based on rules akin to at least one of the following games: craps and roulette.

10. The table game system of claim 1, further comprising:

a plurality of player terminals in communication with the controller that allow for receipt of wagers on the game of chance.

11. The table game system of claim 1, further comprising:

a display screen associated with the controller for displaying indicia of the single card.

12. The table game system of claim 1, further comprising:

a transparent housing disposed over the shuffling device and the card retrieval device.

13. A table game system for facilitating play of a game of chance, comprising:

a card shuffling machine to be located on a table surface having a plurality of wagering areas, the card shuffling machine including a plurality of card locations;

each of the plurality of card locations for receiving one card of a defined set of cards, with each card having indicia information relevant to an outcome for the game of chance;

a card retrieval device disposed adjacent the table surface and in communication with the card shuffling machine, the card retrieval device being configured to automatically retrieve a selected card identified by the card shuffling machine and to move the selected card from its card location to a reading position;

a card reader disposed at the reading position for electronically obtaining the indicia information of the selected card when the selected card is moved to the reading position; and a controller in communication with the card retrieval device to effectuate movement of the card retrieval device from the card location to the reading position, the controller being in communication with the card reader to automatically obtain the selected card indicia information after it is electronically obtained by the card reader.

14. The table game system of claim 13, wherein the card retrieval device consists of a mechanical arm that is adapted to grab the selected card and remove it from its card location and move the selected card to the reading position away from the card shuffling machine.

15. The table game system of claim 13, wherein the card retrieval device is disposed beneath the plurality of card positions for pushing the selected card upward.

16. The table game system of claim 15, wherein the card retrieval device is a push rod.

17. The table game system of claim 13, wherein each of the defined set of cards includes a unique RFID tag associated therewith, which contains the card indicia information; and wherein the card reader is an RFID reader for reading the RFID tag associated with the selected card to obtain the card indicia information.

18. The table game system of claim 13, wherein each of the defined set of cards includes a unique bar code associated therewith, which contains the card indicia information; and wherein the card reader is a bar code reader that is adapted to read the bar code associated with the selected card to obtain the card indicia information.

19. The table game system of claim 13, wherein the card reader is a video camera that obtains the card indicia information.

20. The table game system of claim 13, wherein the outcome of the game of chance is determined based on rules akin to at least one of the following games: craps and roulette.

21. The table game system of claim 13, further comprising:

a plurality of player terminals in communication with the controller that allow for receipt of wagers on the game of chance.

22. The table game system of claim 13, further comprising:

a display screen associated with the controller for displaying the indicia information of the selected card.

23. The table game system of claim 13, further comprising:

a transparent housing disposed over the shuffling device and the card retrieval device.

24. The table game system of claim 13, wherein the card retrieval device is operable to return the selected card to its card position after the selected card indicia information is electronically obtained by the card reader.

* * * * *